US007958663B2

(12) United States Patent
Saunders, III

(10) Patent No.: US 7,958,663 B2
(45) Date of Patent: Jun. 14, 2011

(54) SUSPENDED GUN REST

(76) Inventor: James W. Saunders, III, Gaithersburg, MD (US)

( * ) Notice: Subject to any disclaimer, the term of this patent is extended or adjusted under 35 U.S.C. 154(b) by 183 days.

(21) Appl. No.: 12/230,696

(22) Filed: Sep. 3, 2008

(65) Prior Publication Data

US 2009/0064560 A1 Mar. 12, 2009

Related U.S. Application Data

(60) Provisional application No. 60/935,983, filed on Sep. 10, 2007.

(51) Int. Cl.
*F41A 23/00* (2006.01)

(52) U.S. Cl. ..... 42/94; 211/64; 212/179; 248/330.1; 242/385.4

(58) Field of Classification Search ..... 42/94; 211/64; 242/381, 382, 371, 382.5, 384.7, 385, 396, 242/396.5, 378.3, 385.4, 378.1, 378.2, 379; 248/489, 492, 58, 59, 317, 329, 330.1, 327, 248/328, 323; 212/179
See application file for complete search history.

(56) References Cited

U.S. PATENT DOCUMENTS

| | | | | | |
|---|---|---|---|---|---|
| 164,937 | A | * | 6/1875 | Robertson | 248/492 |
| 180,327 | A | * | 7/1876 | Craine | 242/379 |
| 213,131 | A | * | 3/1879 | Peaslee | 248/492 |
| 224,538 | A | * | 2/1880 | Hotchkiss | 248/330.1 |
| 330,616 | A | * | 11/1885 | Petersen | 248/330.1 |
| 345,172 | A | * | 7/1886 | Petersen | 242/378 |
| 346,098 | A | * | 7/1886 | Griswold | 242/378 |
| 603,146 | A | * | 4/1898 | Lord | 248/492 |
| 613,841 | A | * | 11/1898 | Lord | 248/492 |
| 889,570 | A | * | 6/1908 | Ayers | 242/375.3 |
| 1,087,310 | A | * | 2/1914 | Maas | 211/117 |
| 1,332,383 | A | * | 3/1920 | Davis et al. | 242/378 |
| 2,514,628 | A | * | 7/1950 | Cortes | 191/12.4 |
| 2,637,109 | A | * | 5/1953 | Willis | 33/293 |
| 2,696,917 | A | * | 12/1954 | Kershaw | 212/179 |
| 3,896,576 | A | * | 7/1975 | Wolf et al. | 40/367 |
| 4,140,296 | A | * | 2/1979 | Guzman Guillen | 248/445 |
| 4,825,589 | A | * | 5/1989 | Straw et al. | 47/67 |
| 5,263,675 | A | | 11/1993 | Roberts et al. | |
| D348,215 | S | | 6/1994 | Melhorn | |
| 5,491,920 | A | | 2/1996 | McCullers | |
| 5,685,103 | A | | 11/1997 | Wiggins | |
| 5,806,508 | A | * | 9/1998 | Stempien et al. | 124/86 |
| 6,029,386 | A | | 2/2000 | Globig | |
| 6,059,213 | A | * | 5/2000 | Phillips | 242/378.4 |
| 6,142,439 | A | * | 11/2000 | Aramaki | 248/327 |
| 6,202,964 | B1 | | 3/2001 | Thornhill | |

(Continued)

FOREIGN PATENT DOCUMENTS

DE 40 00 091 A1 7/1991

*Primary Examiner* — Michael Carone
*Assistant Examiner* — Jonathan C Weber
(74) *Attorney, Agent, or Firm* — Richard C. Litman

(57) ABSTRACT

The suspended gun rest includes a pivoting arm adjustably mounted to a rigid support by a mount. The mount comprises an L-shaped bracket with a mounting hole and three holes for adjustment screws. A cradle is provided which includes two strings, a string routing system, a locking mechanism and a spindle. A hook is connected to one end of the pivoting arm. The two strings are connected to the spindle and routed through the cradle by the routing system and attached to the hook on the pivoting arm.

20 Claims, 23 Drawing Sheets

U.S. PATENT DOCUMENTS 6,464,190 B1 * 10/2002 Aramaki ..... 248/327
6,634,610 B1 * 10/2003 Ricci et al. ..... 248/330.1
6,694,661 B1 * 2/2004 Langford ..... 42/94
6,726,163 B2 * 4/2004 Eppard et al. ..... 248/219.4
6,948,690 B1 * 9/2005 Sandel ..... 248/218.4
2003/0038218 A1 * 2/2003 Eppard et al. ..... 248/219.4
2004/0216351 A1 11/2004 Eppard et al.
2006/0137233 A1 6/2006 Meeks

* cited by examiner

SUSPENDED GUN REST

CROSS-REFERENCE TO RELATED APPLICATION

This application claims the benefit of U.S. Provisional Patent Application Ser. No. 60/935,983, filed Sep. 10, 2007.

BACKGROUND OF THE INVENTION

1. Field of the Invention

The present invention relates to devices for aiming firearms, and particularly to a suspended gun rest for use with a rifle that permits the shooter to easily adjust his aim both vertically and horizontally, and then locks into place, providing a stable rest without removing the rifle from the rest.

2. Description of the Related Art

When using a firearm, particularly a rifle, for hunting or the like, it is often desirable to use a support to steady one's aim. It can be difficult to accurately sight a moving target and keep one's aim on the mark while moving the rifle smoothly to keep track of the target, whether holding the rifle in a standing or sitting position. Although tripods and other similar supports have been used for this purpose in the past, the variable nature of the terrain often does not permit the proper stable use of tripods, and, more importantly, such supports only provide support of the firearm which is fixed in both the horizontal and vertical directions, thus severely limiting the range of motion and not allowing a hunter to properly track a moving target. It would be desirable to provide a gun rest that can be suspended from an elevated support, and that can further be easily adjusted both horizontally and vertically. Thus, a suspended gun rest solving the aforementioned problems is desired.

SUMMARY OF THE INVENTION

The suspended gun rest includes a pivoting arm adjustably mounted to a rigid support by a mount. The mount includes an L-shaped bracket with a mounting hole and three holes for adjustment screws. A cradle is provided that includes two strings, a string routing system, a locking mechanism and a spindle. A hook is connected to one end of the pivoting arm. The two strings are connected to the spindle and routed through the cradle by the routing system and attached to the hook on the pivoting arm.

The suspended gun rest provides a device that allows the user to freely move a firearm without adjusting the rest until the target is located, and then the rest is locked into place. The gun rest further provides a mounting device that allows the rotation axis of a pivoting arm to be vertical and can be mounted to any rigid support. The suspended gun rest allows the user to go from a sitting position to a standing position without moving the mounting system. A user can put the firearm in a resting position without disconnecting the rest from the firearm.

These and other features of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENTS

Figure 1:
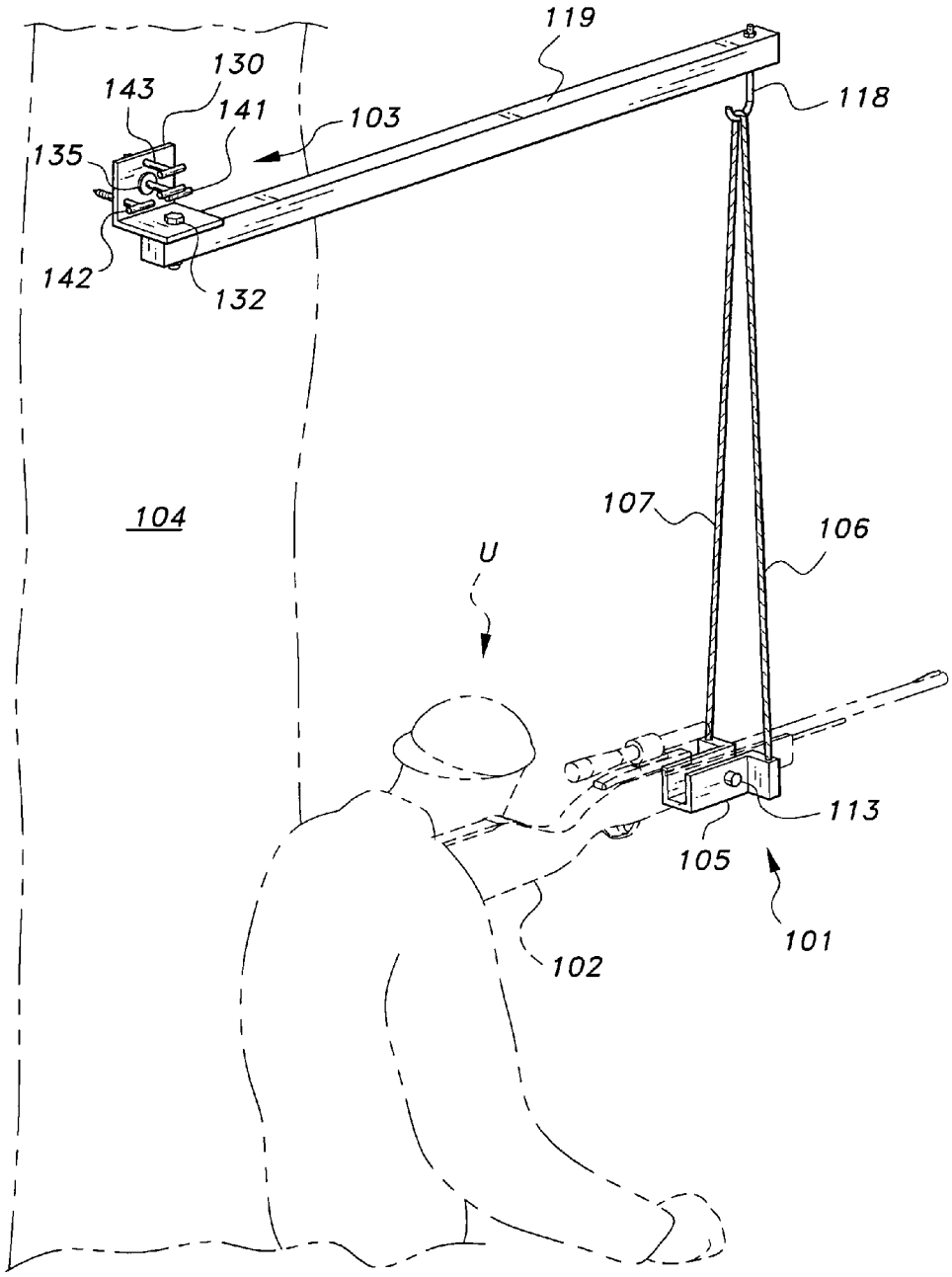
FIG. 1 is an environmental, perspective view of a suspended gun rest according to the present invention.

The present invention is directed towards a suspended gun rest 101. As shown in FIG. 1, the suspended gun rest 101 supports a firearm 102 and has a mount 103 with a pivoting arm 119 that is attached to a rigid support 104 (such as the exemplary tree shown in FIG. 1). The rest 101 includes a cradle 105, a pair of strings or lines 106, 107, a string routing system 116, 117 and 120 (to be described in greater detail below, with regard to FIGS. 3 and 4), a locking mechanism 121 (preferably including a pivoting lever 109, best shown in FIGS. 3 and 4), and a spindle 110. The string or line may be formed from regular string, cable and/or chain, or any other suitable material.

Figure 2:
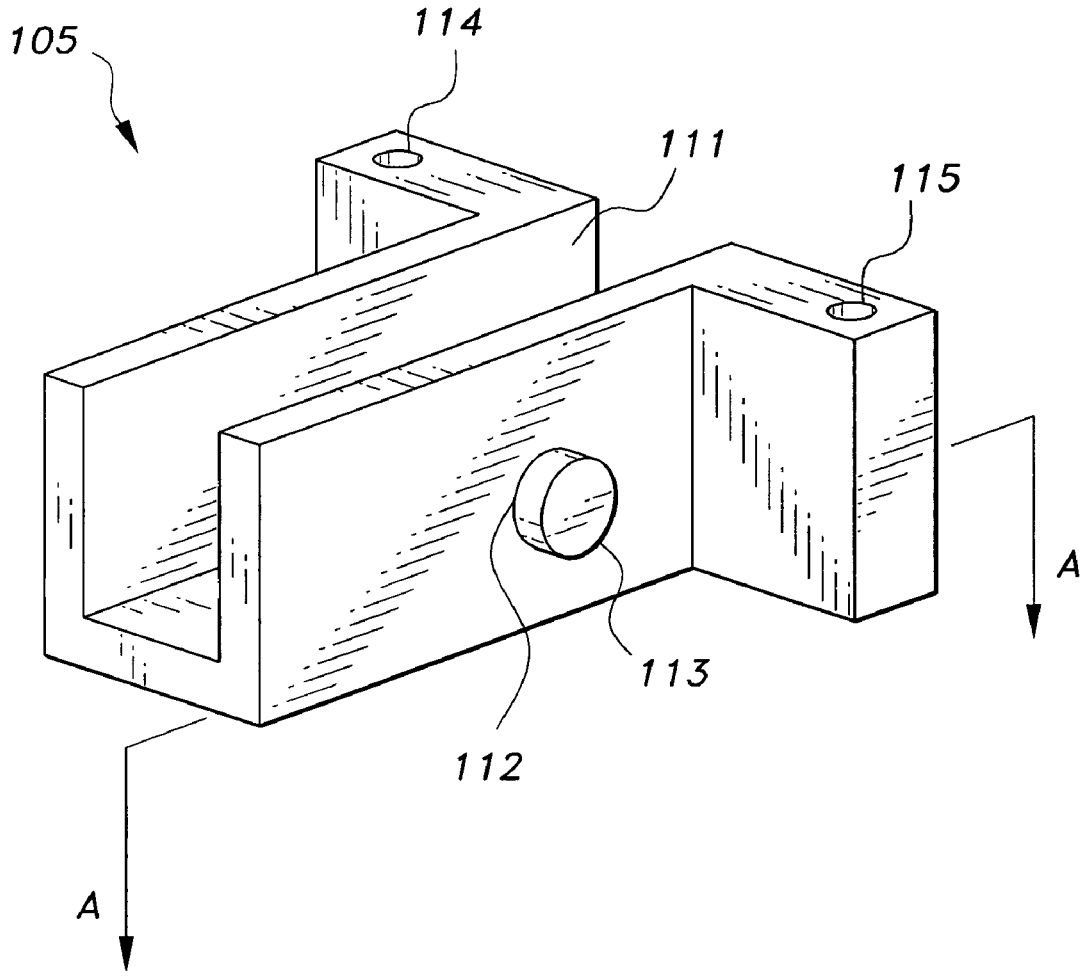
FIG. 2 is a perspective view of the cradle according to the present invention.
Figure 3:
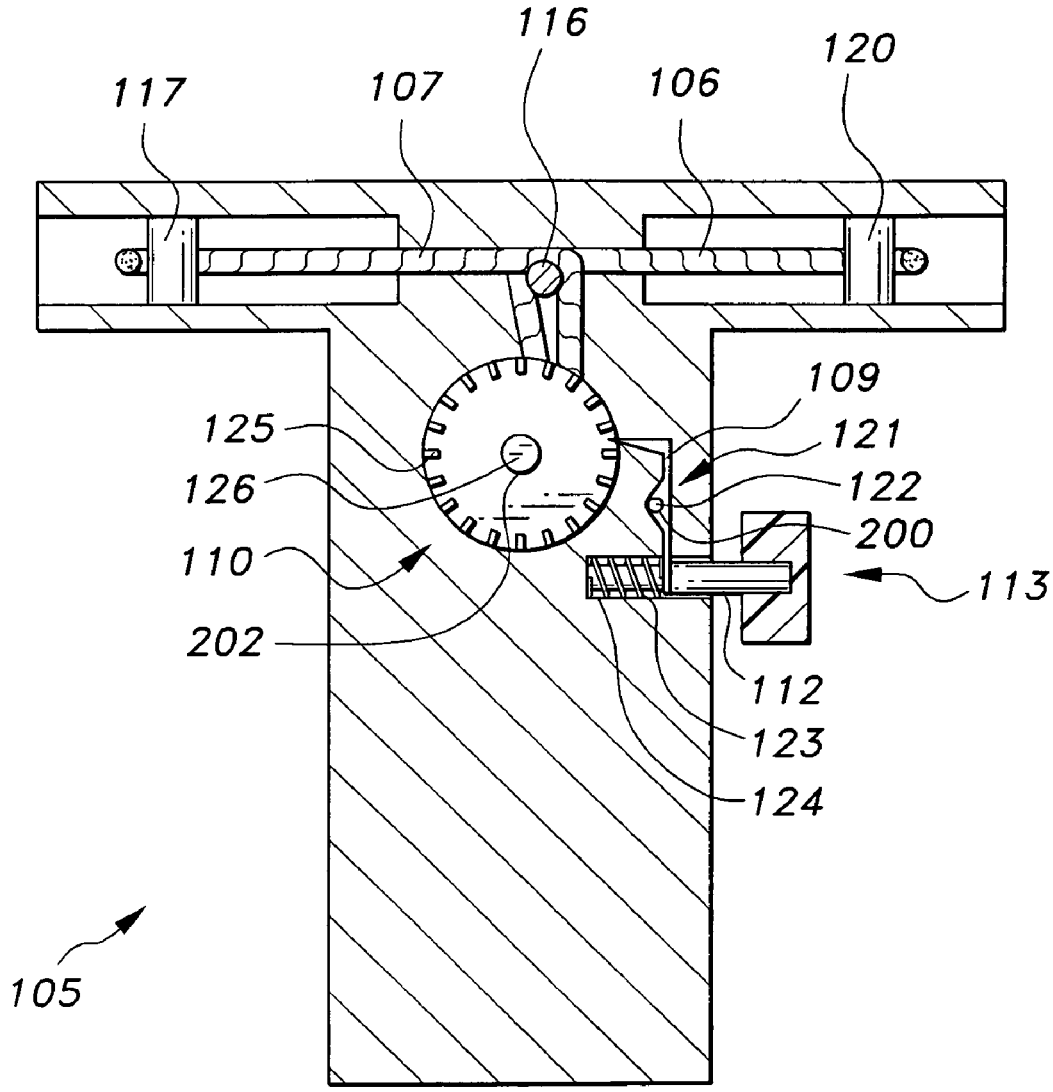
FIG. 3 is a sectional view of the cradle according to the present invention.

FIG. 2 shows the cradle 105 having an opened slot 111 formed therethrough to receive the firearm. The cradle 105 has a guide hole 112 on the side for a button 113 to move in and out of the cradle 105. The top of the cradle 105 has two holes 114, 115 formed therethrough for the two strings 106, 107 to pass in and out of. As shown in FIG. 3, string 107 is attached to a spindle 110, rotatably mounted within cradle 105, and then comes off the spindle 110 on the right side (in FIG. 3) and is wrapped on the right side of a pin 116. String 107 then passes over pin 116 (in the orientation shown in FIG. 3) to the left and wraps around pin 117. Pin 117 routes the string 107 upward and out through hole 114. String 107 then connects to a hook 118 mounted on pivot arm 119 (shown in FIG. 1). String 106 is also attached to the spindle 110 and, as shown in FIG. 3, comes off the spindle 110 on the right side (in the orientation shown in FIG. 3) and is wrapped on the left side of pin 116. The string 106 then passes to the right and wraps around pin 120 which routes the string upward through the hole 115, where string 106 connects to the hook 118 on pivot arm 119. It should be understood that the left and right orientations are shown for exemplary purposes only, and that the string portions extending to the left and right may be reversed. Pins 116, 117 may further have a friction-reducing device affixed thereto, such as a pulley, for example, for reducing the frictional forces between the strings and pins.

Figure 4:
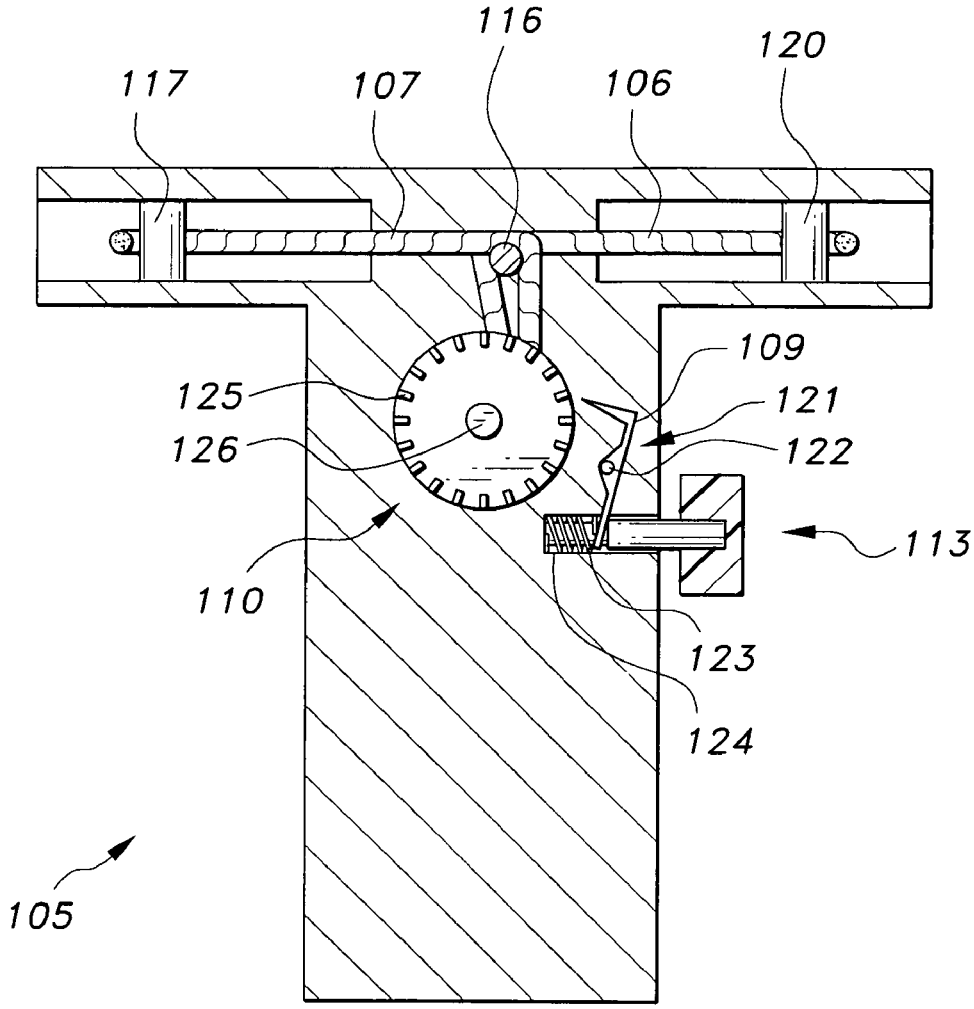
FIG. 4 is a sectional view of the cradle, as in FIG. 3, illustrating a locking mechanism of FIG. 3 in a disengaged configuration.
Figure 18:
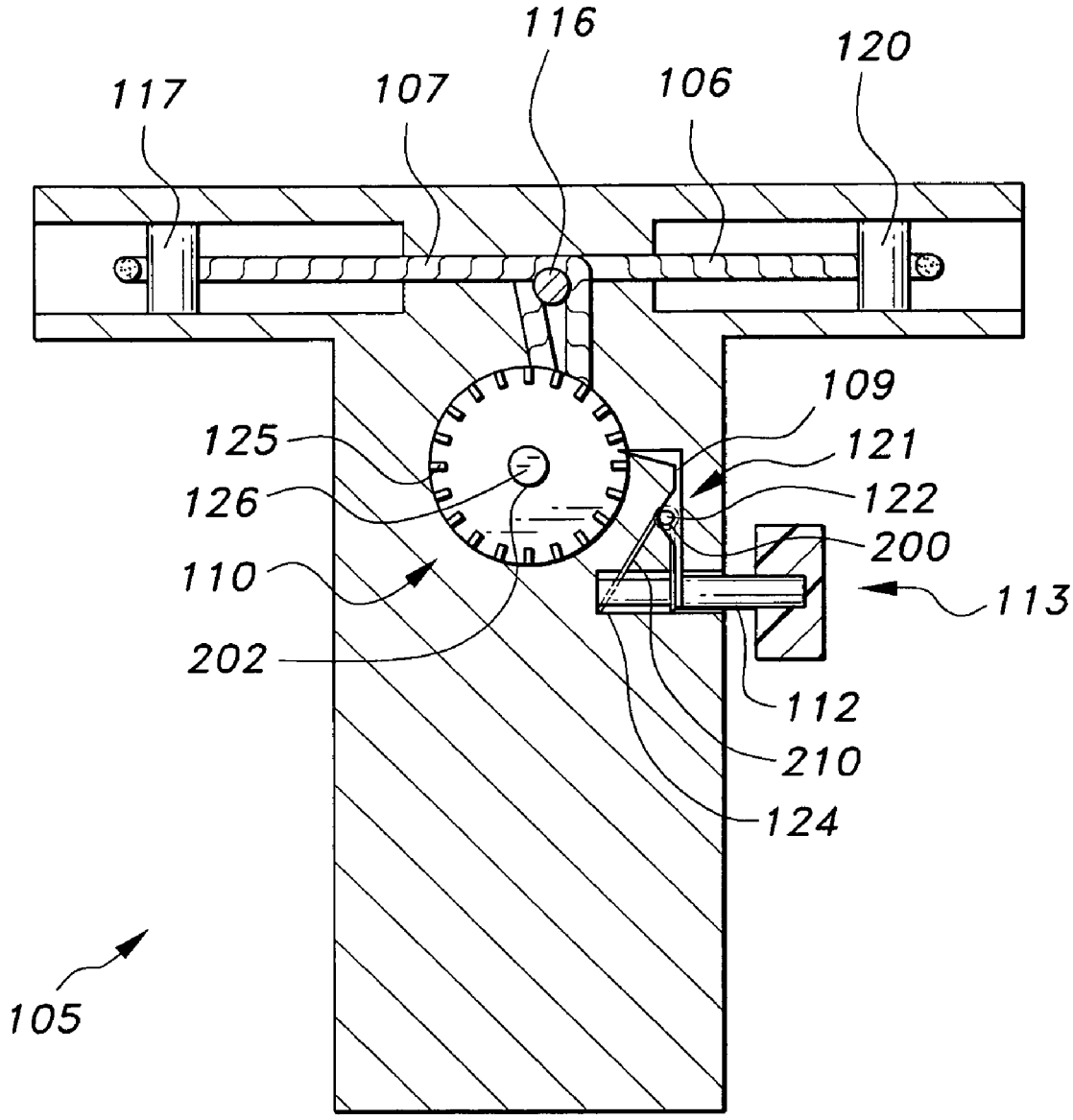
FIG. 18 is a sectional view of an alternative embodiment of the cradle according to the present invention.

The locking mechanism 121 includes a lever 109 having a hole 200 formed centrally therethrough, and is mounted on a shaft 122 inside the cradle 105, with shaft 122 passing through hole 200. One end of lever 109 has a button 113 secured to one side thereof and a spring 123 secured to the other side thereof, as shown. The button 113 and spring 123 are located in a guide hole 124. The other end of the lever 109 is releasably received within the slots formed between blocks 125, which are formed circumferentially about the spindle 110 to selectively lock the spindle 110 in place (best shown in FIG. 5). Button 113 is elastically biased by spring 123. FIG. 4 illustrates the button 113 in a depressed state, with lever 109 disengaged from spindle 110. In the alternative embodiment of FIG. 18, the helical spring 123 mounted within passage 124 has been replaced by a torsion spring 210 mounted within the cradle.

Figure 5:
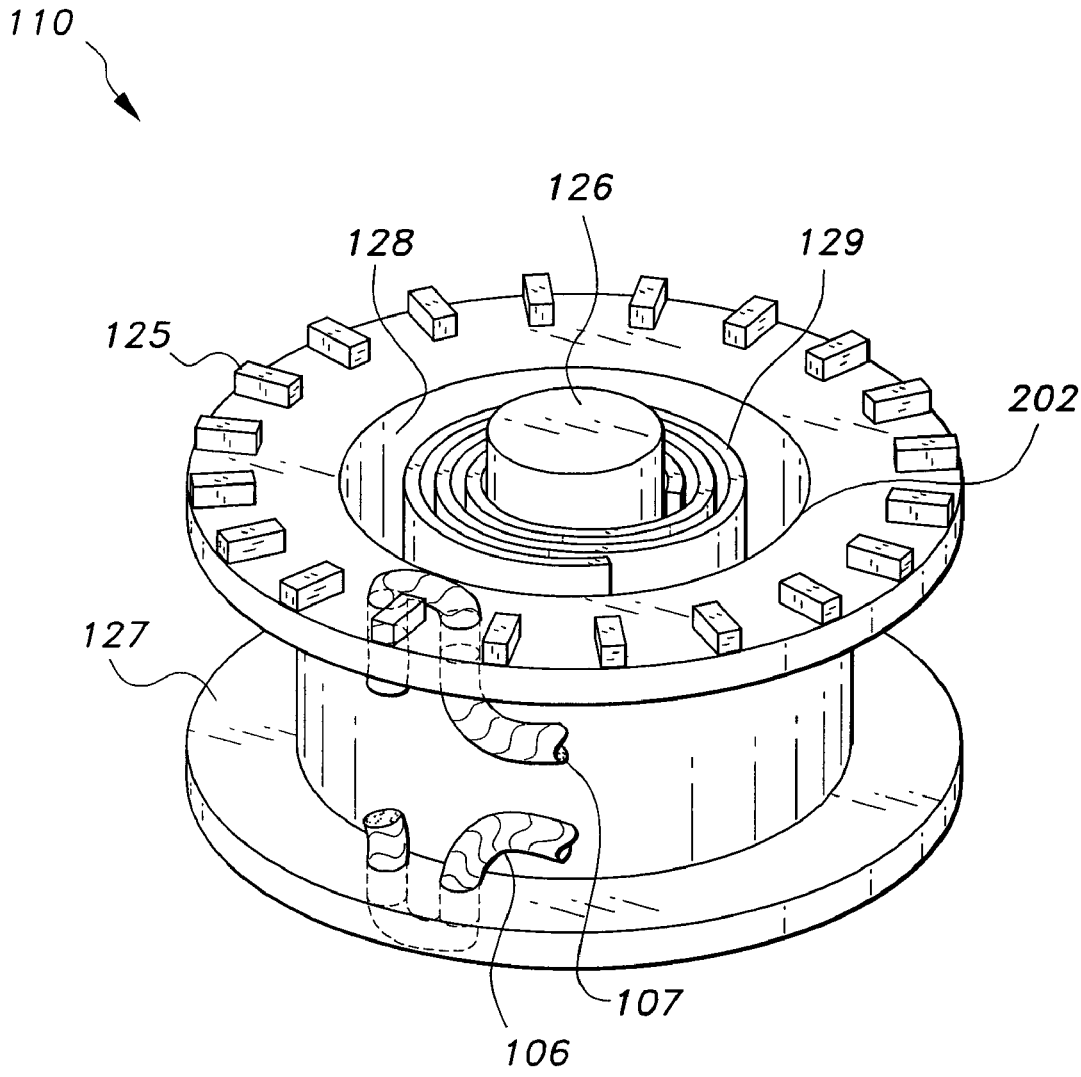
FIG. 5 is a perspective view of the spindle according to the present invention.

A shaft 126 inside the cradle 105 is inserted through a hole 202 formed through the center of the spindle as shown in FIG. 5. The spindle 110 preferably has a spool-type shape 127 with an open area 128 formed in the center. Mounted within the open area 128 is a spiral torsion spring 129. One end of the spiral torsion spring 129 is attached to the shaft 126 and the other end is attached to the spindle 110. The spindle 110 includes blocks 125 on the top surface.

Figure 6:
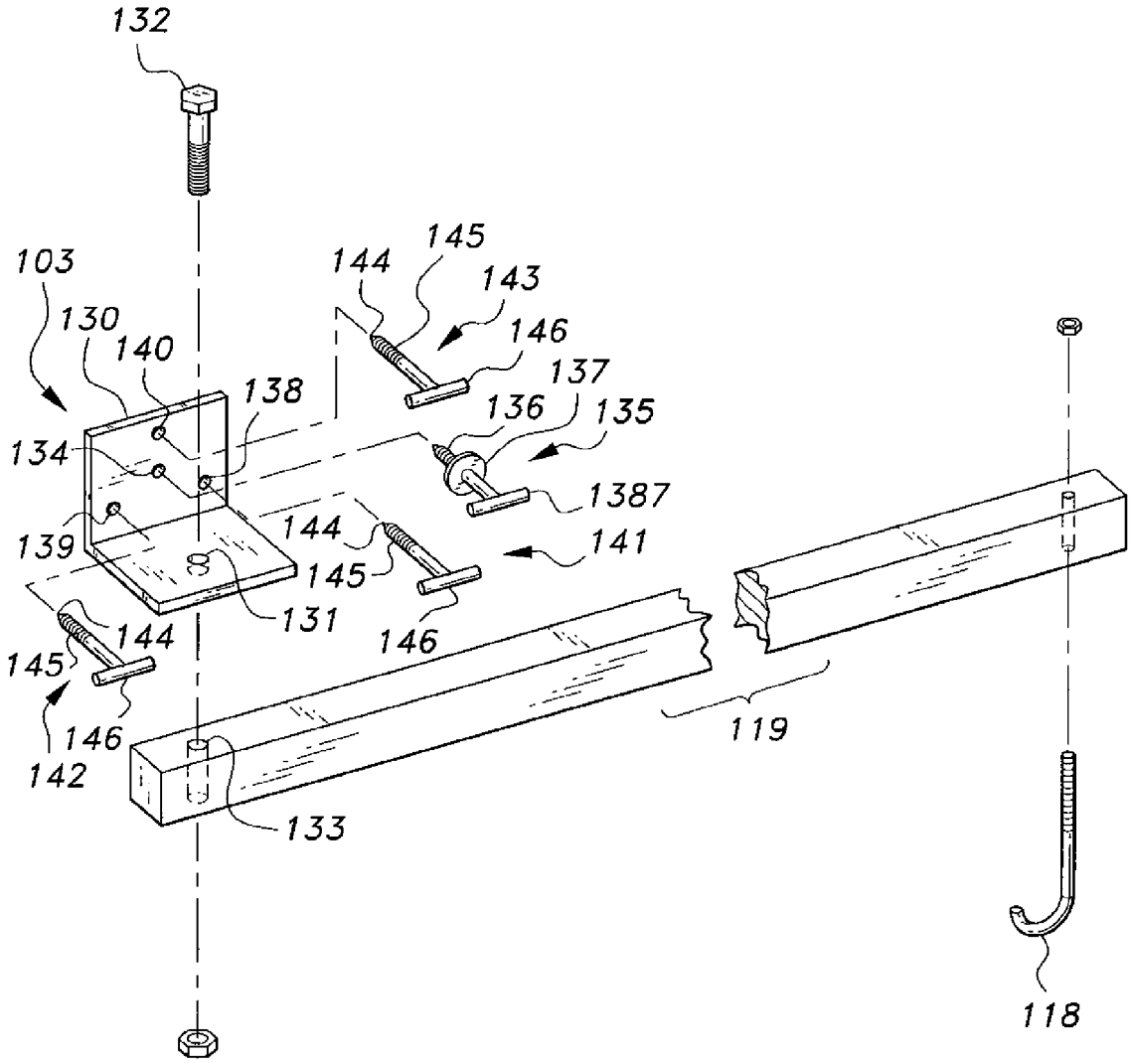
FIG. 6 is an exploded view of the mount according to the present invention.

Referring to FIG. 6, the mount 103 includes an L-shaped bracket 130 with a hole 131 formed through the lower side of the L-bracket 130. A bolt 132 is removably inserted inside hole 131. Bolt 132 is also inserted into the hole 133 formed through one end of the pivot arm 119. The other end of the pivoting arm 119 has hook 118 secured thereto, and projecting downwardly therefrom. The backside of the L-bracket 130 preferably has four holes formed therethrough. One hole 134 is located in the center of back side of the L-bracket 130. A mounting screw 135 is inserted through hole 134. One end of the mounting screw 135 has self-starting threads 136. The middle of the mounting screw 135 has a stop washer 137 and the other end is T-shaped 1387. The stop washer 137 is fixed to the mounting screw 135. The other three holes 138,129, 140 are located in a triangular shape and are threaded. The three bolts 141, 142, 143 are screwed into threaded holes 138,139, 140. Bolt 141 has a pointed end 144 and a threaded shaft 145. The other end of bolt 141 has a T-shape 146. The other two bolts 142, 143 are the same as bolt 141. It should be understood that the number of holes and fasteners, as well as the connectors, are shown for exemplary purposes only, and that the pivoting arm 119 may be secured to the external support 104 by any suitable releasable connector or connectors. For example, the mount 103 can be mounted with a strap instead of mounting screws. Alternatively, two straps can be used to mount the mount 103. As a further alternative, pivoting arm 119 may have an adjustable length.

The device is mounted to the support 104 by positioning the mounting screw 135 through the center hole 134 of the L-bracket 130 and screwing it into the support. Once the L-bracket 130 is mounted to the support the three bolts 141, 142, 143 are adjusted to make the axis of rotation of the pivoting arm vertical and point the bracket in the desired direction.

It should be understood that cradle 105 may be suspended through the usage of any suitable vertical support. For example, the cradle 105 may be suspended from a tree branch, a fixed arm attached to a suitable support, a bipod mount, a tripod mount, etc. Alternatively, the cradle may be positioned on a vertically mounted support, adapted for mounting on the ground or another horizontal support surface. The cradle 105 is preferably movable relative to the vertical support or, alternatively, the vertical support is adjustable in the vertical direction. Such a vertically adjustable support may take the form of an easily transportable telescopic rod, such as a walking stick, for example.

The firearm 102 is placed in the cradle 105 and is moved by pressing the button 113 to disengage the lever 109 from the spindle 110, as shown in FIGS. 1, 3 and 4. Once the button 113 is depressed, the lever 109 of locking mechanism 121 releases the spindle 110 which allows the strings 106, 107 to be wound on to the spindle 110 or unwound off the spindle 110, depending upon whether the cradle 105 is moving up or down in the vertical direction. Once the target is located, the button 113 is released and the spring 123 pushes the lever into the blocks 125 on the spindle 110, which, in turn, locks the spindle 110 in place.

Figure 7:
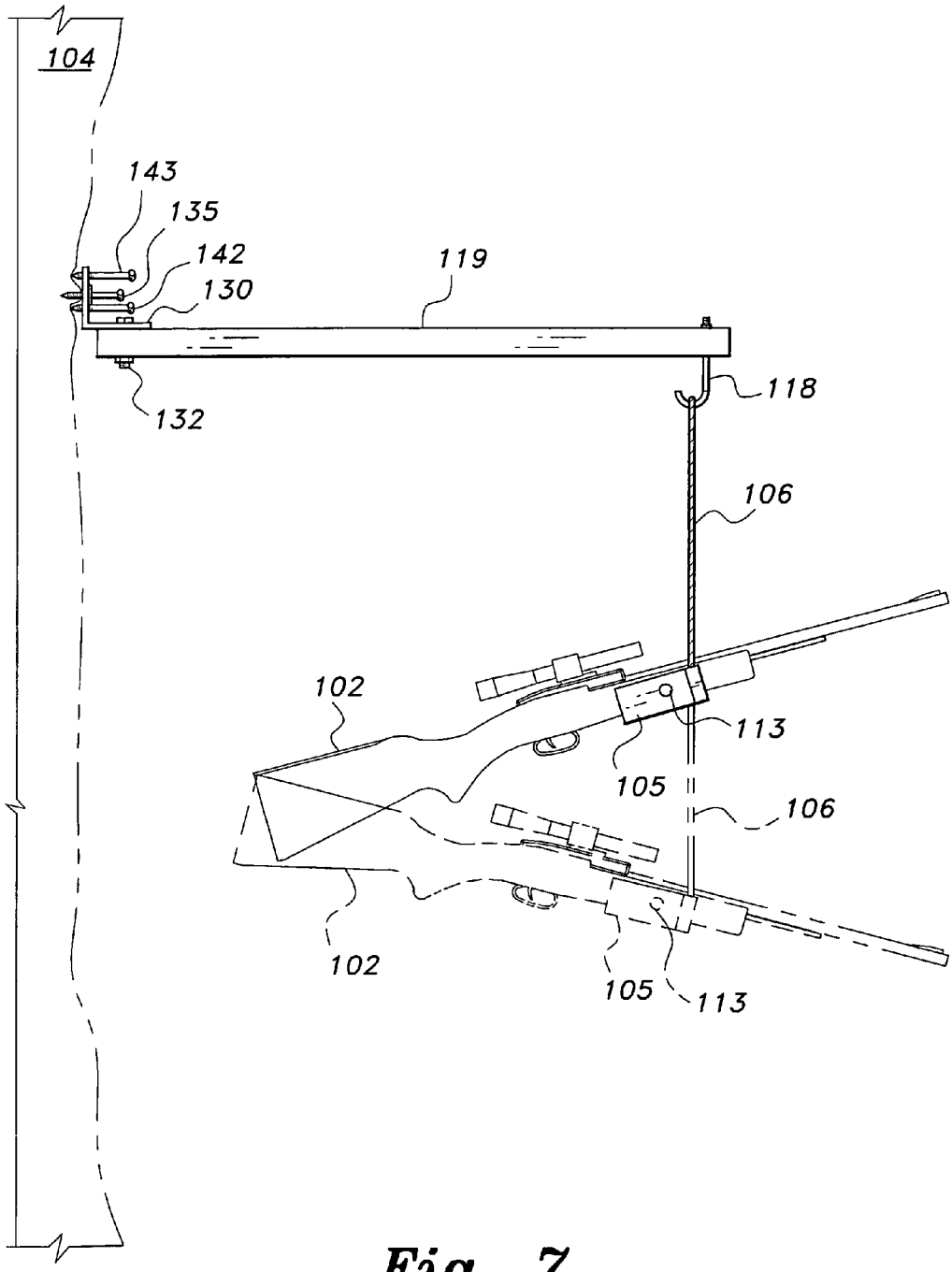
FIG. 7 is a side view of the rest according to the present invention, illustrating vertical motion of the cradle and the supported firearm.

The present invention allows the user to freely move the firearm 102, as shown in FIG. 7, without adjusting the rest 101 until the target is located and then is locked into place. The cradle 105 can be vertically adjusted without physically adjusting the rest 101 relative to the firearm 102 and/or mount 103. This vertical adjustment is particularly useful when hunting in valleys. If the target is moving up or down a hill, the rest 101 allows the user to freely follow the target by freely moving the firearm 102 in the vertical direction, as best shown in FIG. 7.

Figure 8:
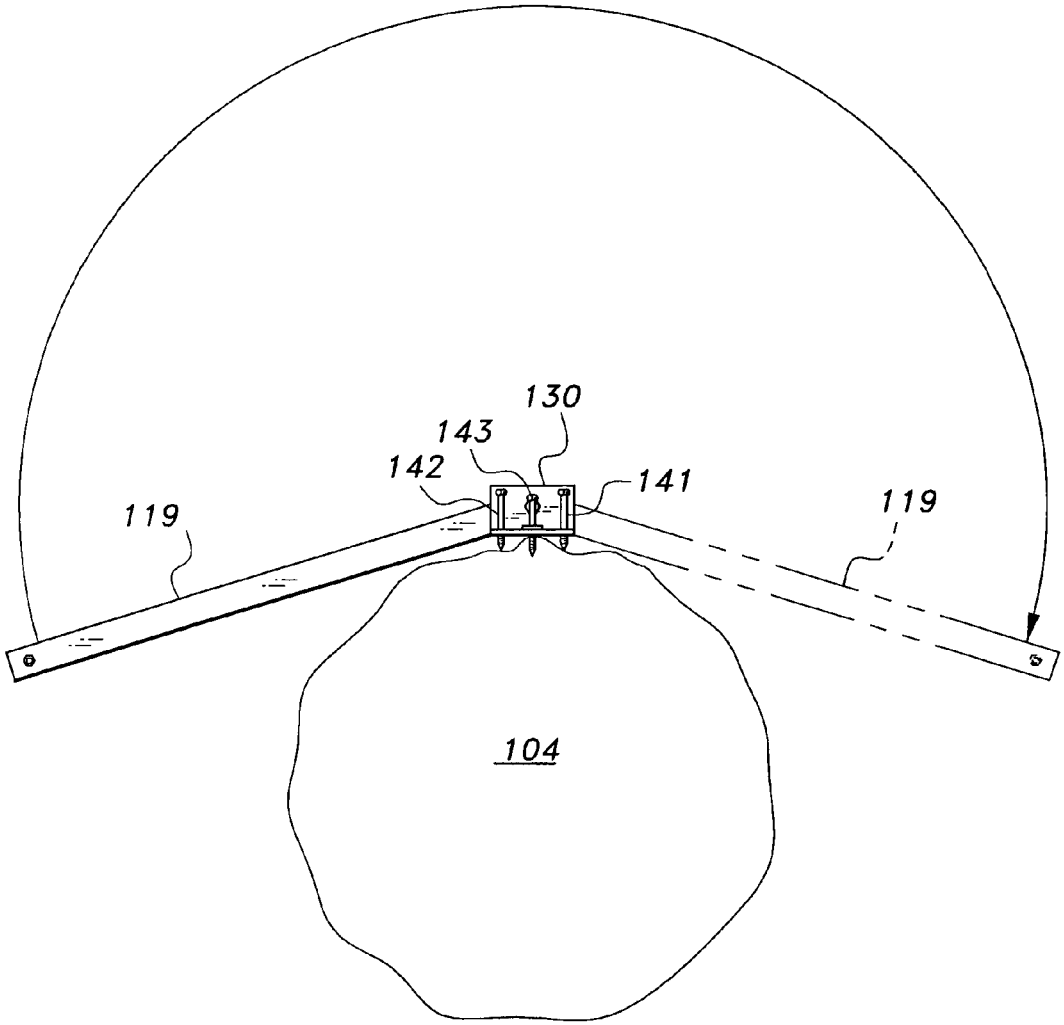
FIG. 8 is a top view of the rest showing the horizontal motion and the mounting of the bracket according to the present invention.

The mounting system 103 allows a user to mount to any support shape. The mounting system allows the user to point the mount in the desired direction. Typical prior art mounts only allow the user to adjust in the horizontal direction but not in the vertical direction. If the L-bracket 130 is not pointed in the proper direction some of the desired horizontal motion is lost, as best illustrated in FIG. 8.

Further, the present invention allows a user to move from a sitting position to a standing position without moving the mount 103 or adjusting the rest 101. The ability of the user to move from a sitting to standing position or vice versa allows the user to adjust the rest 101 to see over an object that may be blocking the target when in a sitting or standing position. Further, the rest 101 can be moved to a resting position without disconnecting the rest 101 from the firearm. When the user needs to use hands, the firearm 102 can be moved into a resting position.

As an alternative, the rest can be built with two spindles inside the cradle, rather than the single spindle described above. This allows for generation of equal tension in the strings. The locking mechanism can also be designed to allow the cradle to be moved freely and then lock the cradle in place by pressing the button.

Figure 9:
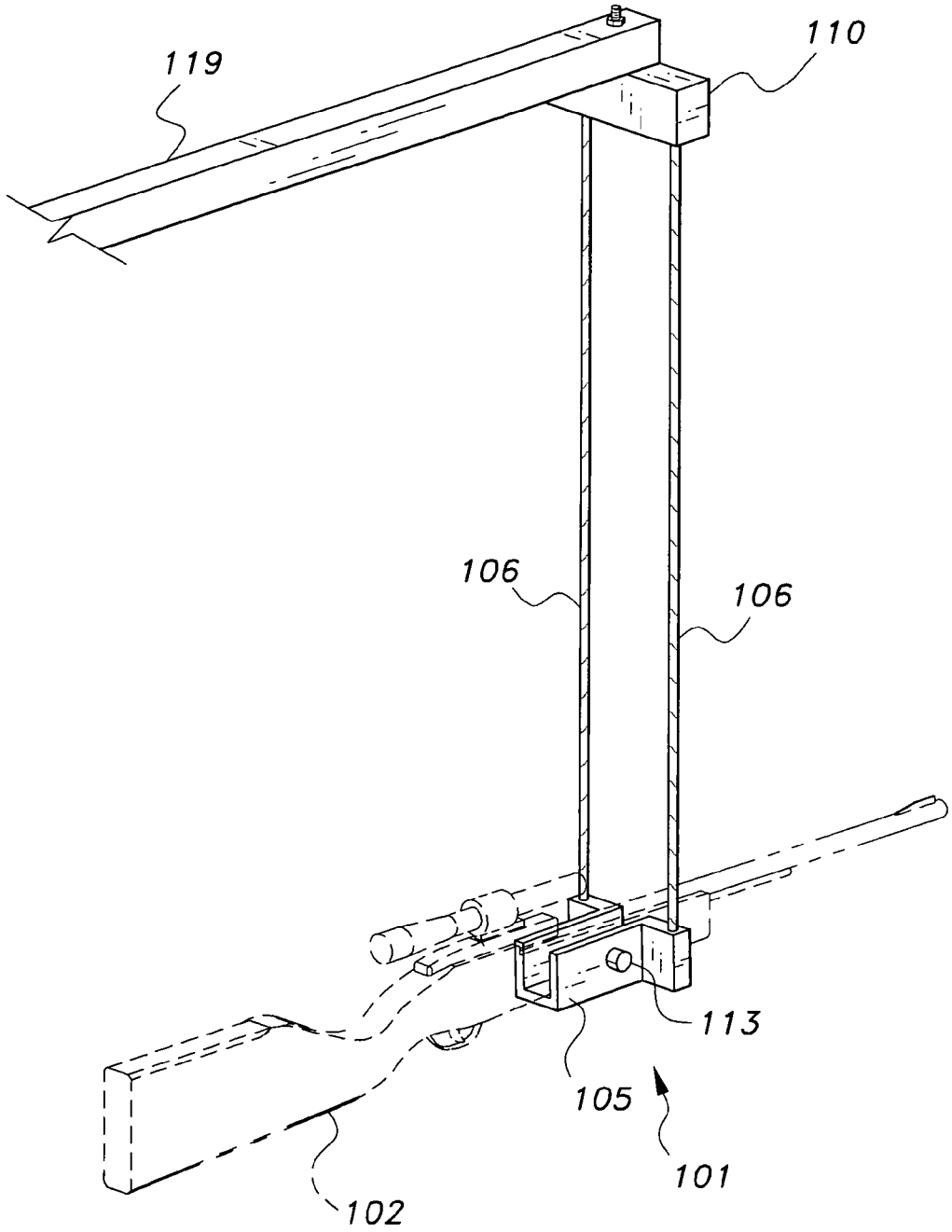
FIGS. 9, 10, 11, 12 and 13 are perspective views of alternative embodiments of the rest.
Figure 10:
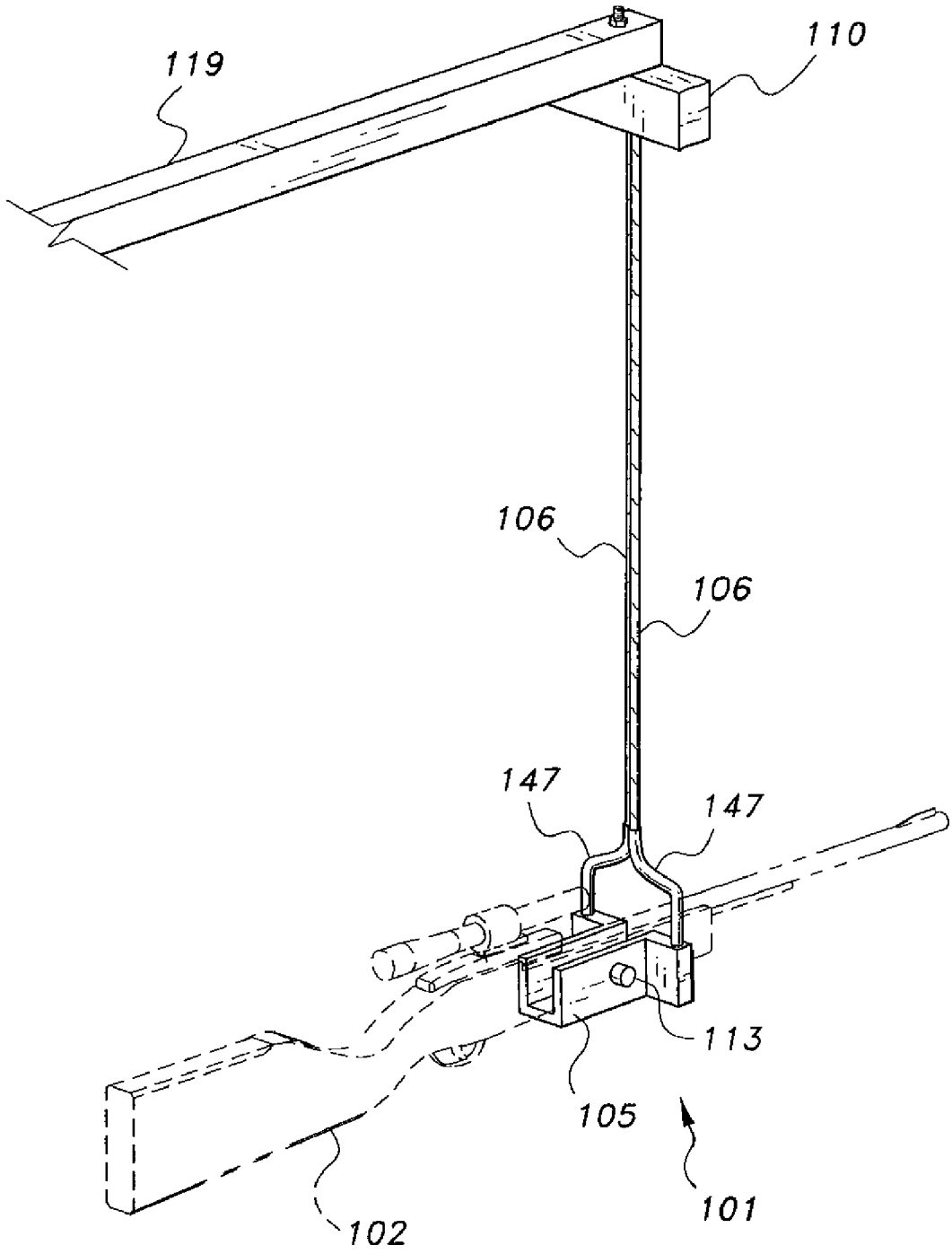
Figure 12:
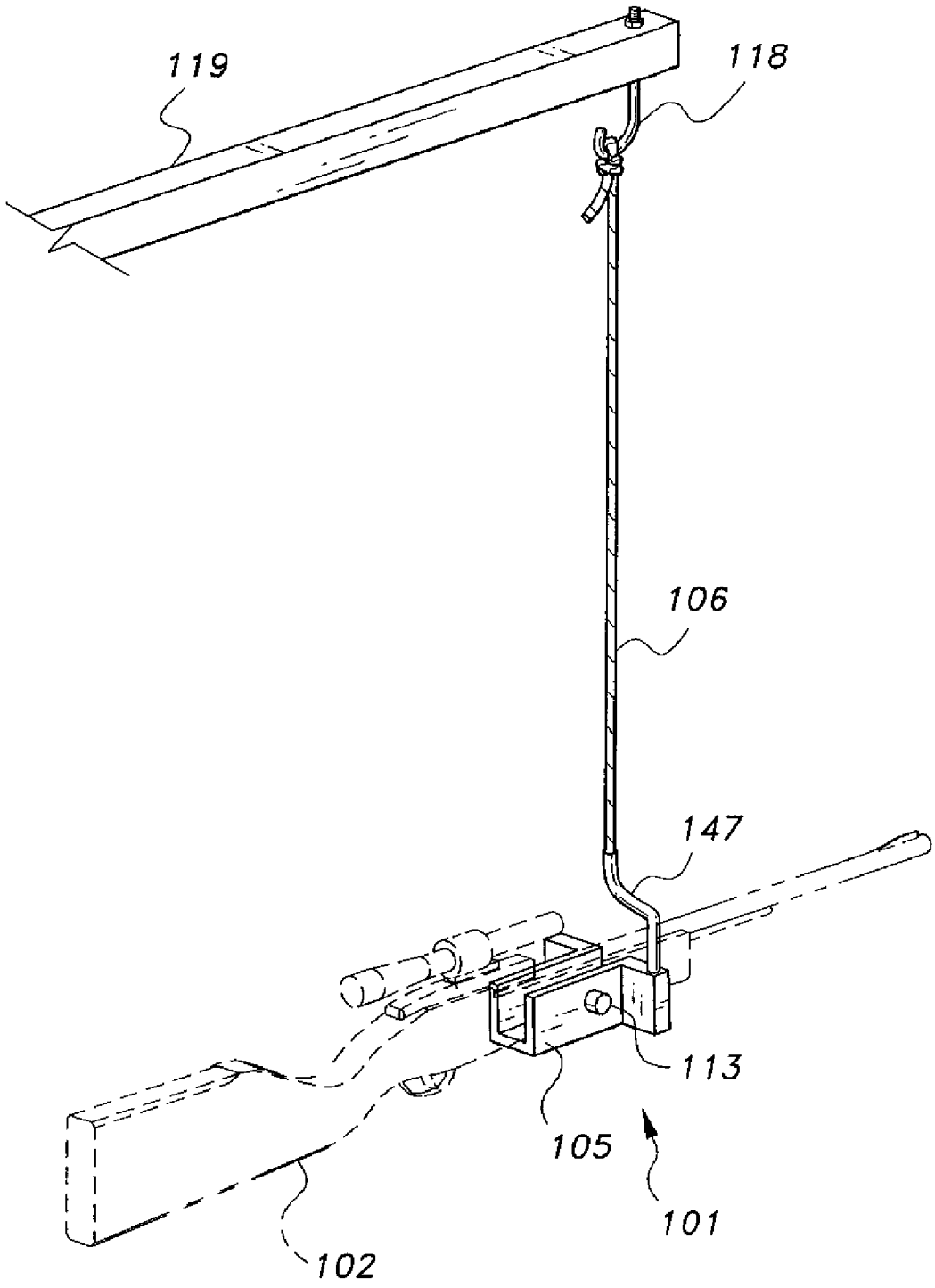

As a further alternative, the spindle 110 can be located on the pivoting arm 119. In this arrangement, one end of the string 106 is connected to the spindle 110 and then is routed through the cradle 105 and back up to the pivoting arm 119. This end of the string 106 is connected directly to the pivot arm 119, as shown in FIG. 9. In this embodiment, the alternative locking mechanism prevents the string 106 from moving through the cradle 105. In the configuration shown in FIG. 9, only one side of the string 106 is locked and the other side is free to move. This causes an asymmetric moment of inertia about the cradle 105. To alleviate this asymmetric moment of inertia, the string 106 can be routed to the center of the cradle through the use of a tube 147, as shown in FIGS. 10 and 12. The tube 147 can be rigid or flexible at the base. The tube 147 can also be made to rotate about the cradle 105.

Figure 11:
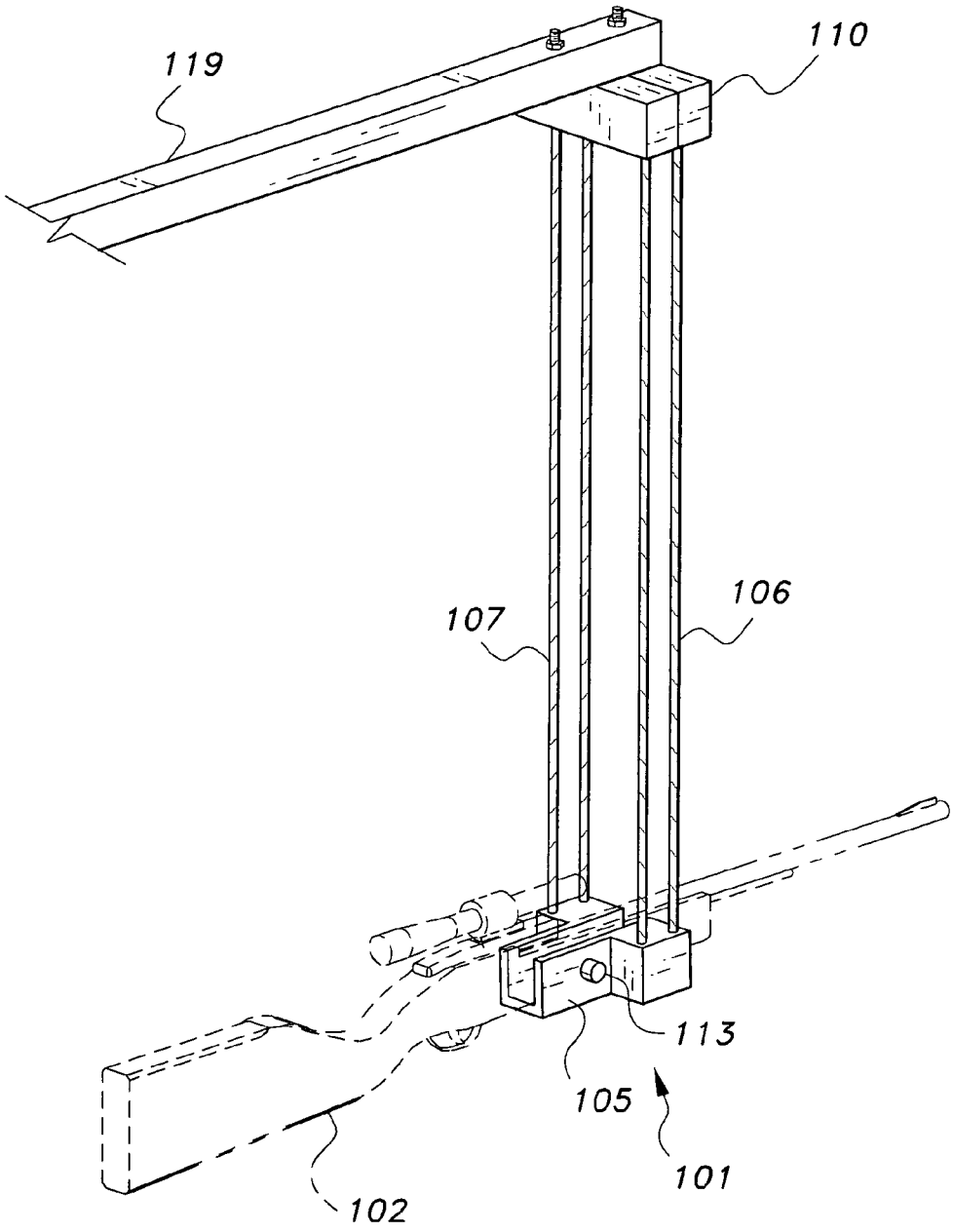
Figure 13:
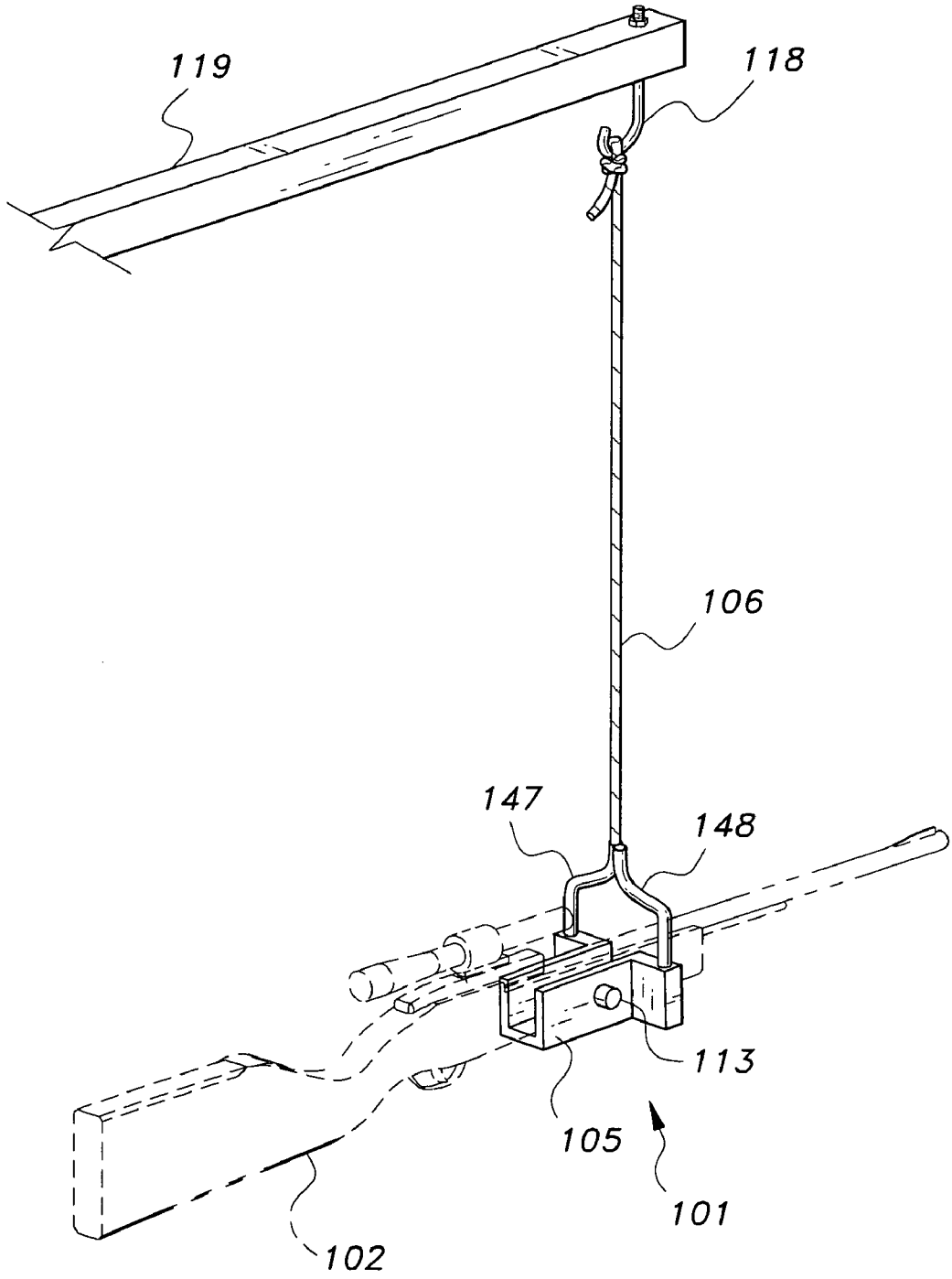

FIG. 11 illustrates a configuration similar to FIG. 9, but with a pair of lines, rather than a single line passing through cradle 105. In this alternative embodiment, two spindles may be attached to the pivoting arm 119 to allow equal tension in the strings 106, 107 and prevent the asymmetric moment of inertia about the cradle 105, since both strings 106, 107 are locked. Further, the rest 101 can be formed with only one string and one spindle 110, as shown in FIGS. 12 and 13. Again, to prevent the asymmetric moment of inertia about the cradle 105, a tube 147 can be used to direct the string to the center of the cradle 105. This tube 147 can be rigid or flexible at the base. Further, a tubular piece 148 can be connected to the tube 147 from the other side of the cradle 105 to provide more stability.

Figure 14:
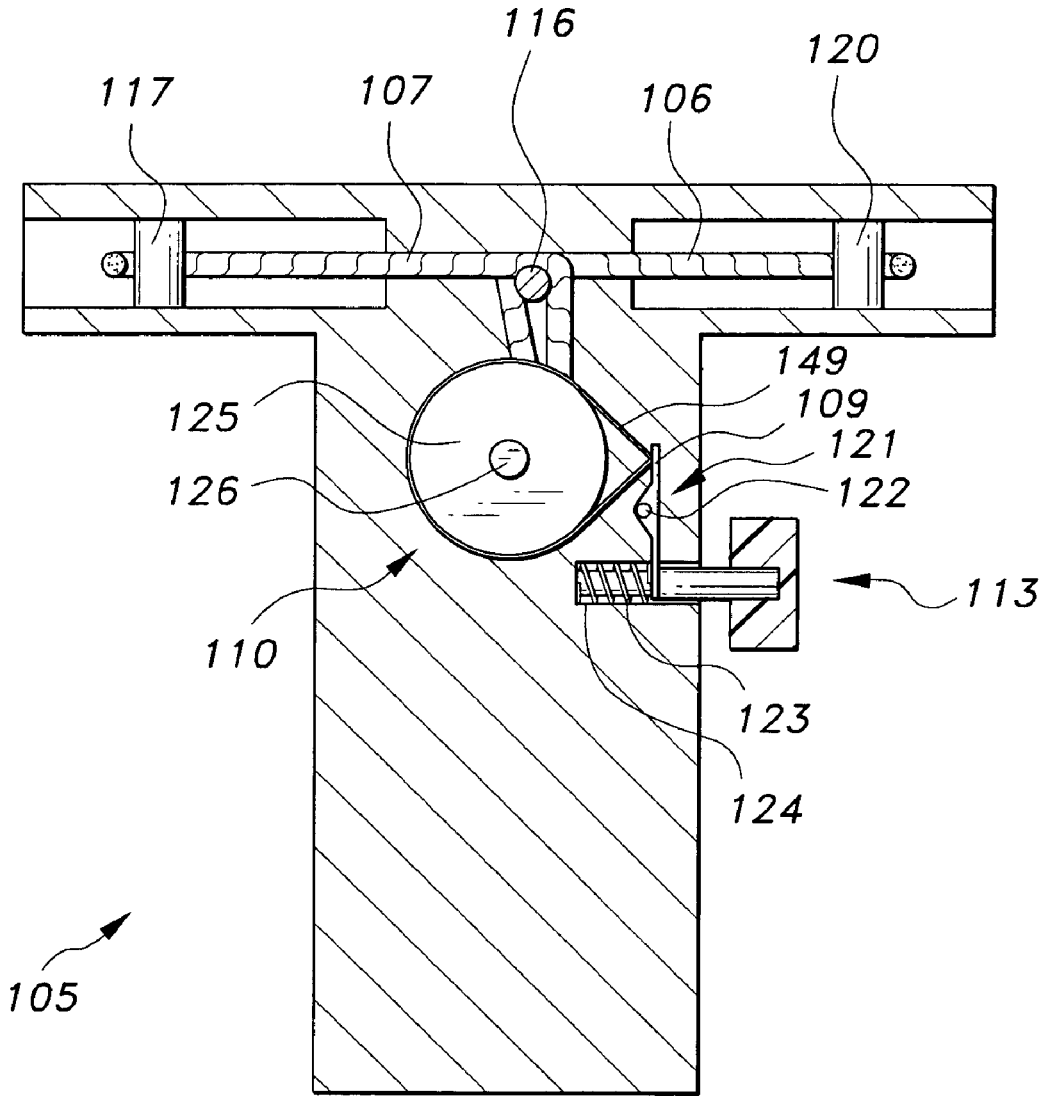
FIG. 14 is a sectional view of an alternative spindle locking device according to the present invention.
Figure 21:
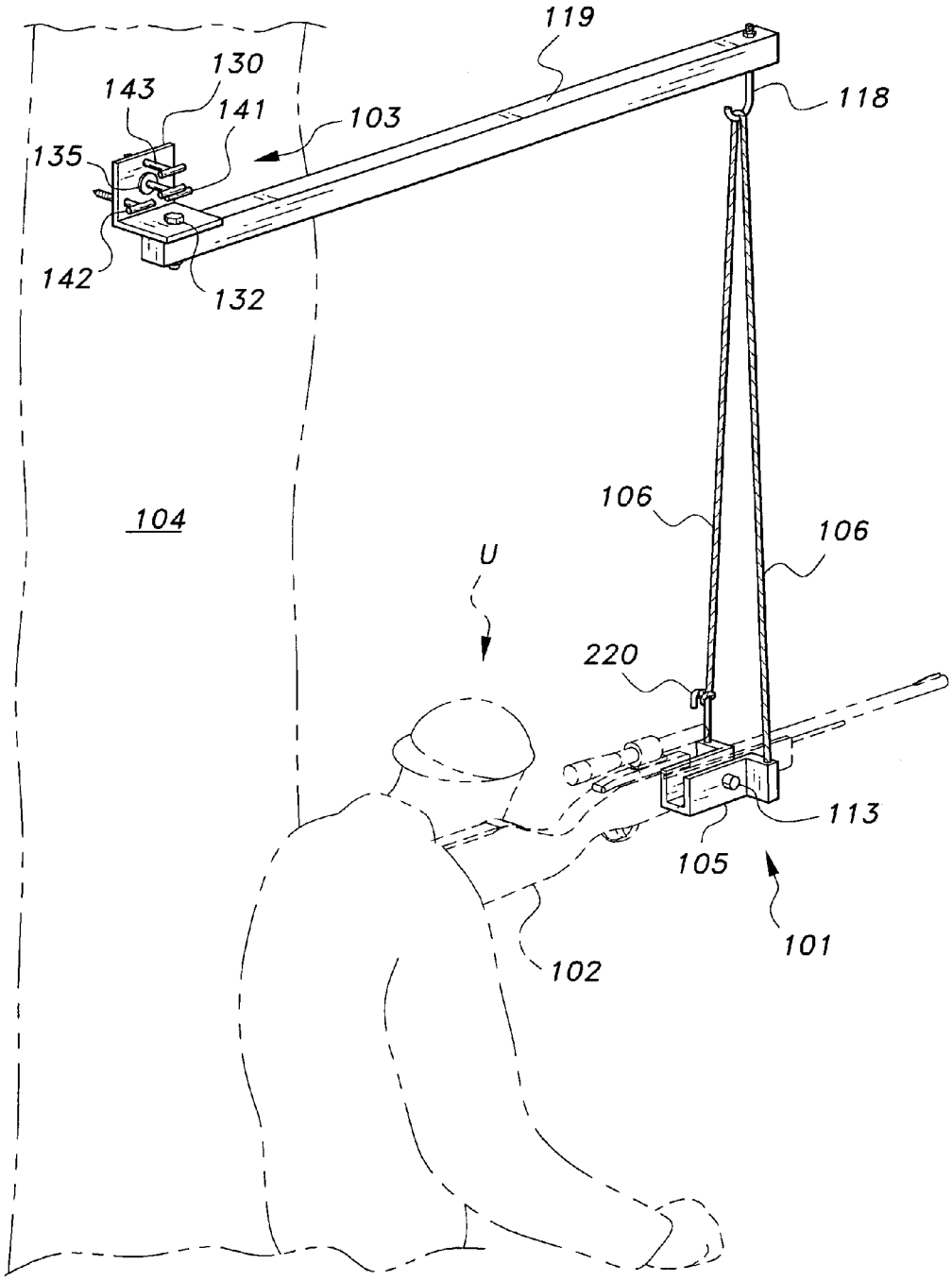
FIG. 21 is an environmental, perspective view of an alternative embodiment of the suspended gun rest.
Figure 22:
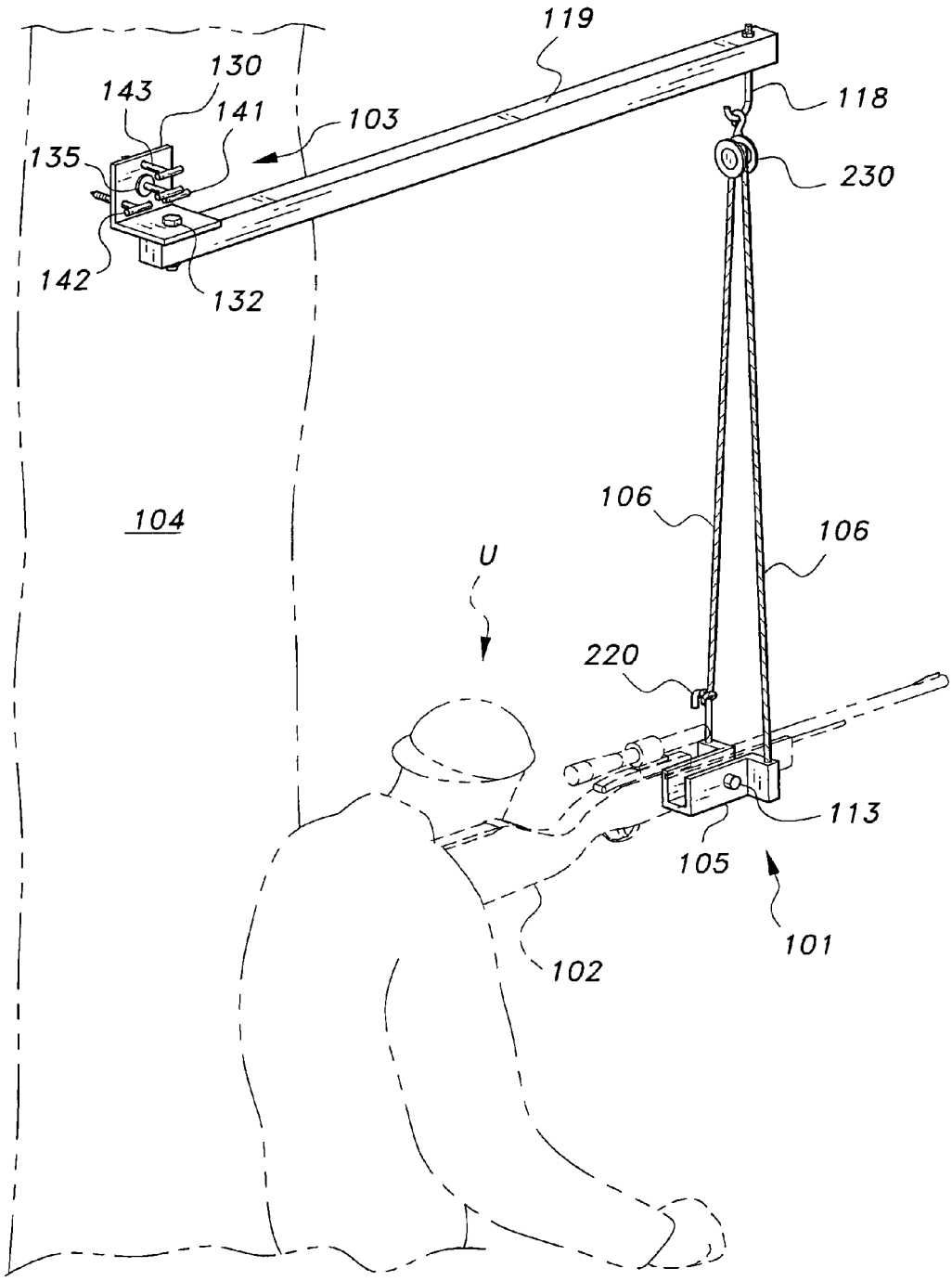
FIG. 22 is an environmental, perspective view of an alternative embodiment of the suspended gun rest.

In the further alternative embodiment of FIG. 14, a strap 149 is wrapped around the spindle 110, to act as an additional locking mechanism. Additionally, as shown in the alternative embodiment of FIG. 21, rather than hooking string 106 to hook 118, as shown in FIG. 12, the string 106 is passed over the hook 118 and then attached to hook 220, which is attached to the cradle 105. FIG. 22 is similar to the embodiment of FIG. 21, but with string 106 passed over a pulley 230, thus reducing the friction between the string 106 and the hook 118 on pivot arm 119. It should be understood that the hooks and pulleys of FIG. 22 may be applied to any of the previous embodiments. For example, the embodiment shown in FIG. 16 may be modified to have one or both of the upper ends of strings 106, 107 passing over a pulley wheel, and a lower end of one to be fixed to a hook similar to hook 220.

Figure 17:
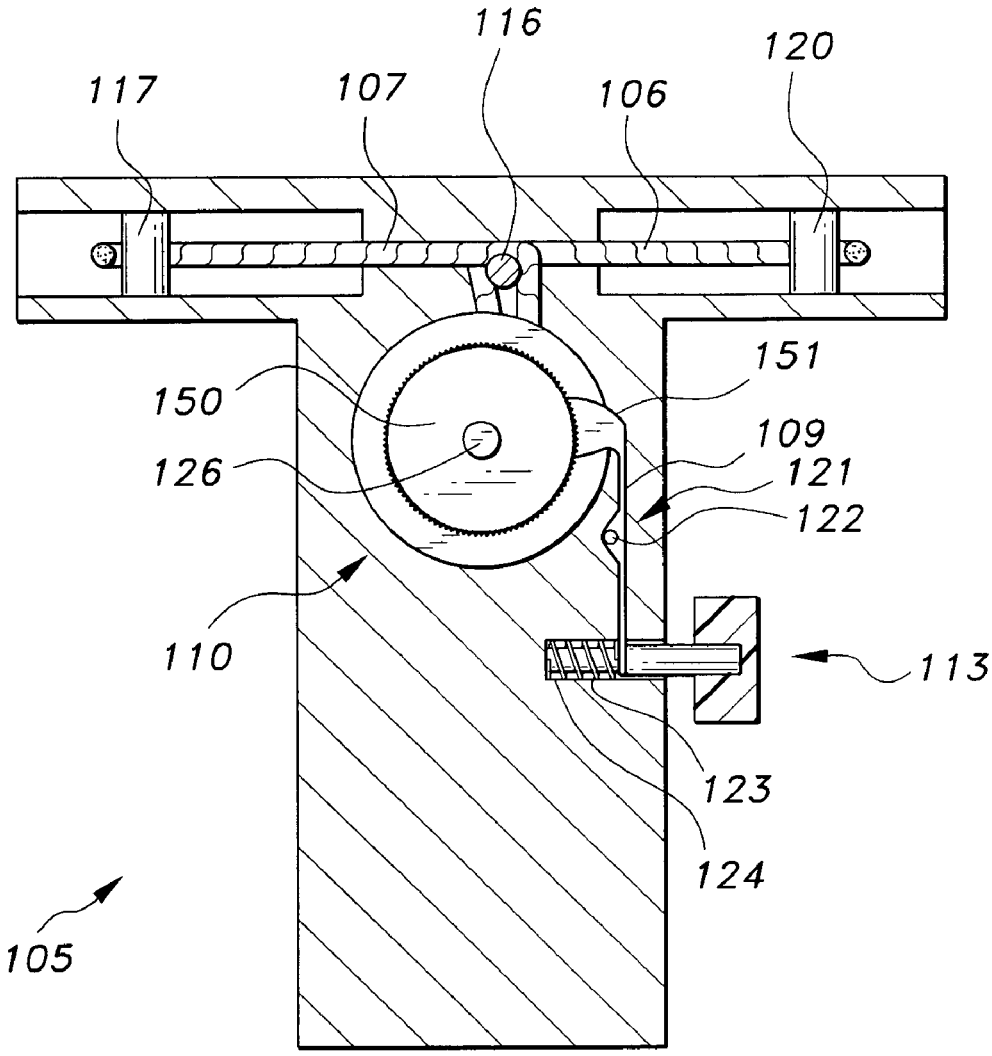
FIG. 17 is a sectional view of the cradle in an alternative embodiment of the locking mechanism.
Figure 19:
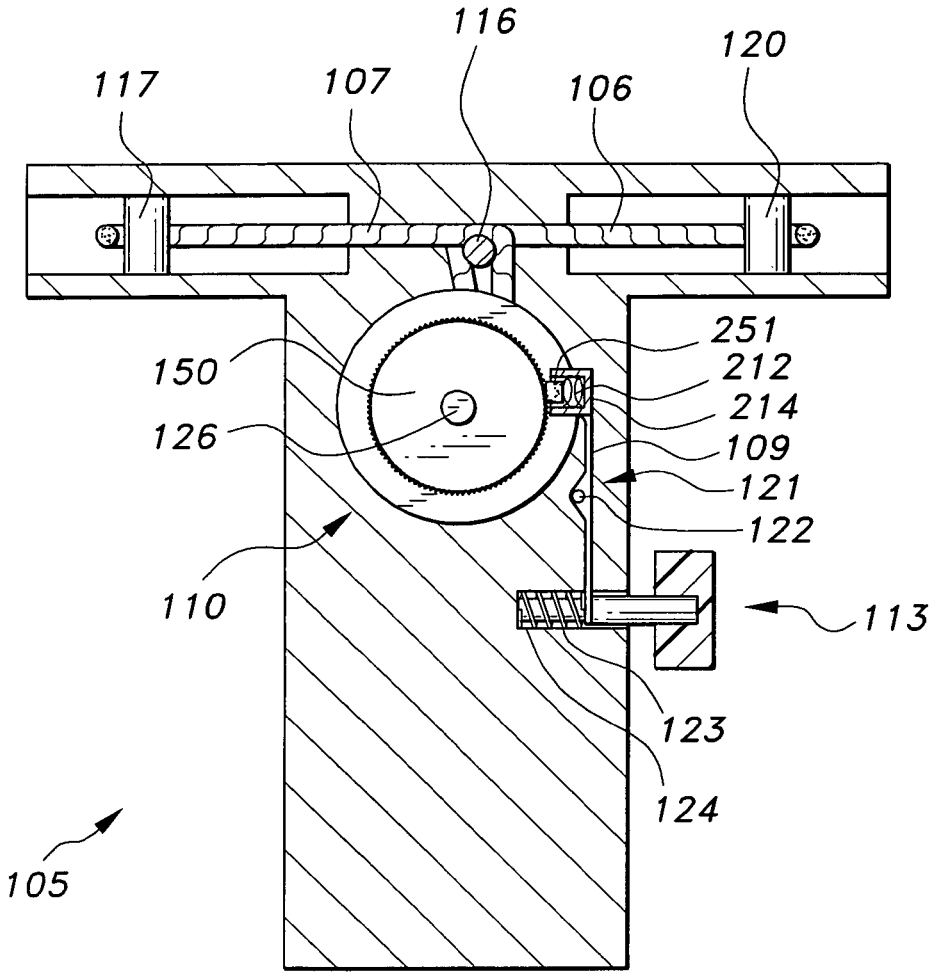
FIG. 19 is a sectional view of another alternative embodiment of the cradle according to the present invention.
Figure 20:
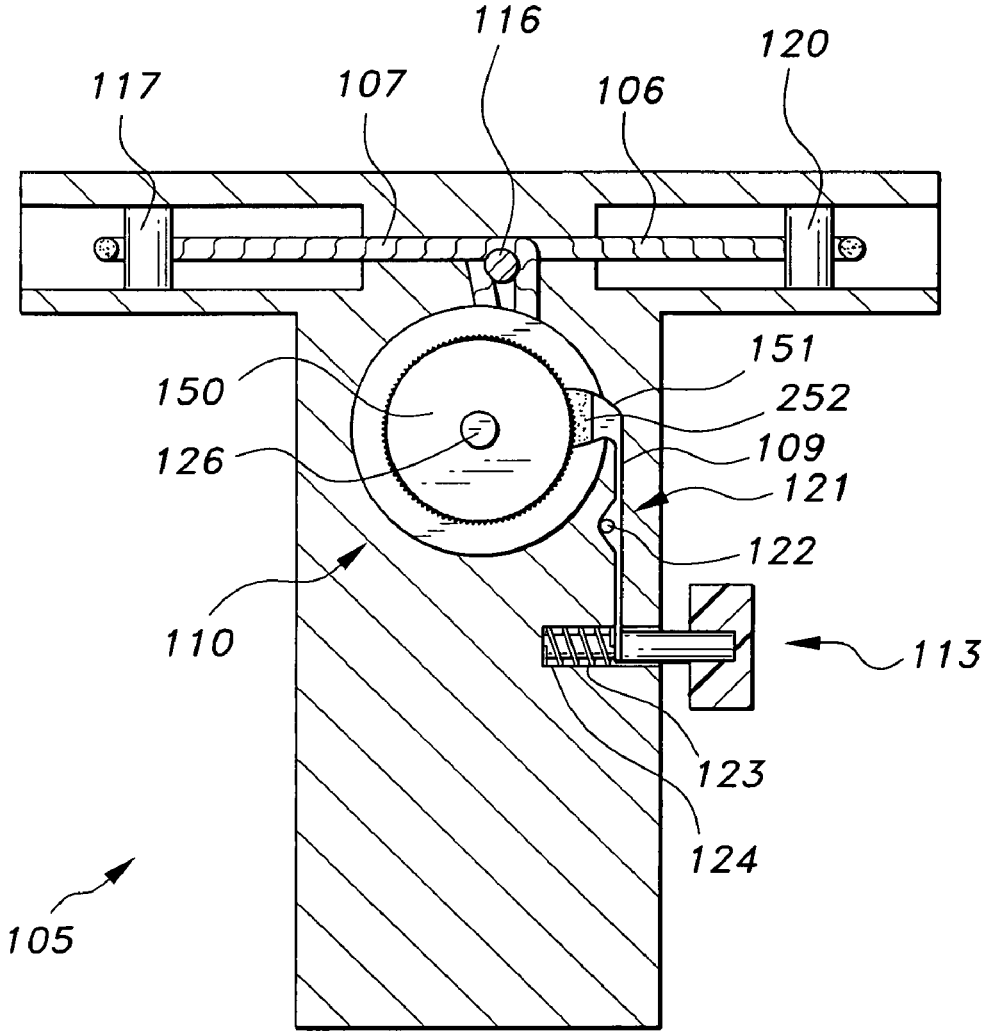
FIG. 20 is a sectional view of another alternative embodiment of the cradle according to the present invention.

The alternative locking mechanism 121 shown in FIG. 17 is formed with two frictionally engaging members: one member 150 is formed circumferentially on the spindle and the other member 151 is mounted on the lever 109. By pressing button 113, the spindle is free to rotate and releasing button 113 allows the friction material, in this case small grooves around the spindle, to be engaged by member 151 to lock the spindle in place. In the alternative embodiment of FIG. 19, the head 151 has been replaced by a substantially rectangular, open head 214. An engaging member 251, formed from the frictionally engaging material of 151, is elastically biased against the spindle by a spring 212, mounted within head 214. This arrangement allows a variable amount of force to be applied to spindle 110. This variable force allows the user to adjust the rest and still have some tension in the strings 106, 107 so that the rest does not drop due to the weight of the rifle when button 113 is depressed. Further, in the alternative embodiment of FIG. 20, the head 151 includes frictional material 252, which is formed from a compressible material, such as rubber, for example, allowing a variable amount of force to be applied to the spindle. Further, member 150 may preferably be formed from a compressible material or a combination of materials, preferably including a compressible material.

Figure 15:
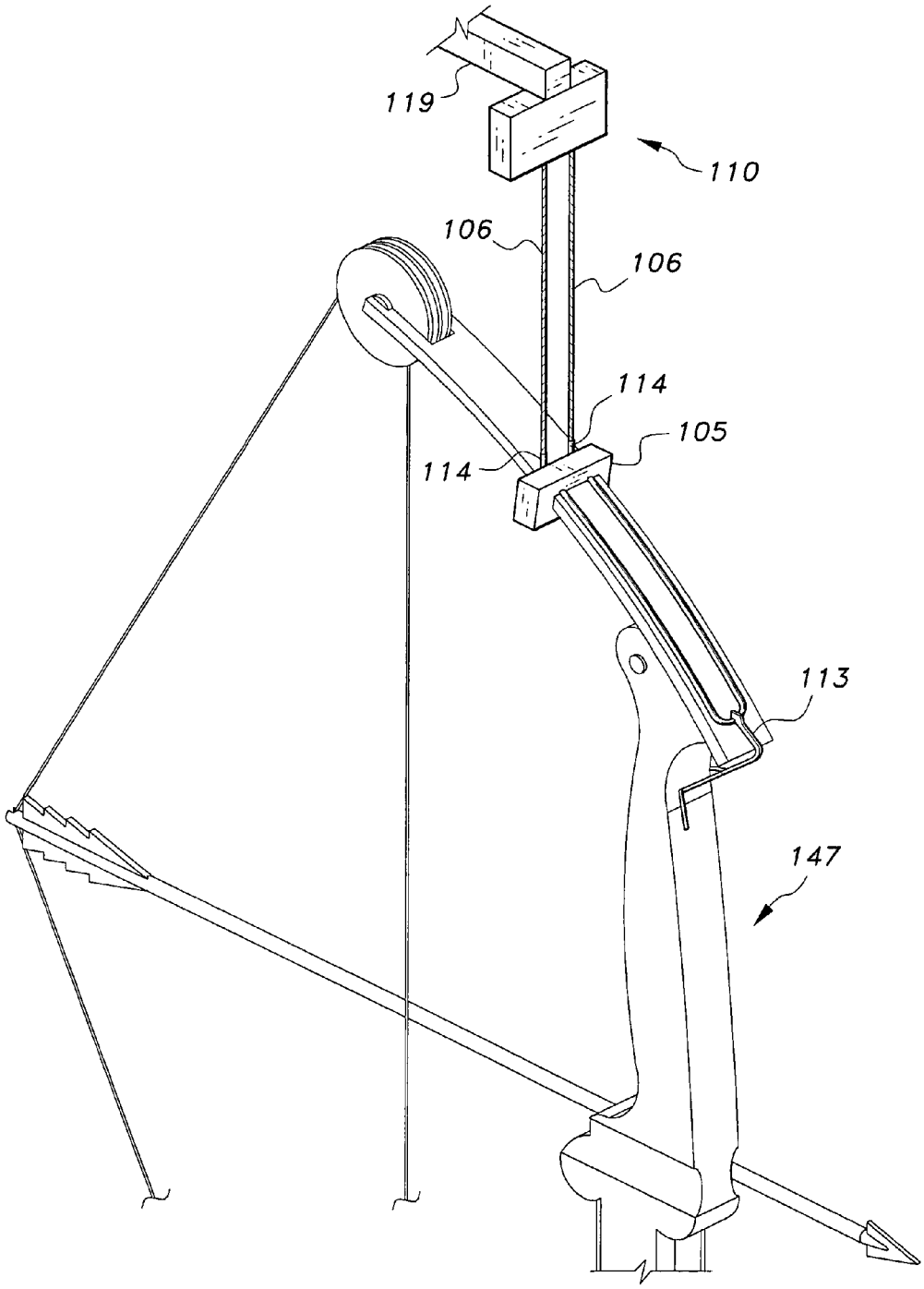
FIG. 15 is a perspective view of the rest being used on a bow according to the present invention.
Figure 16:
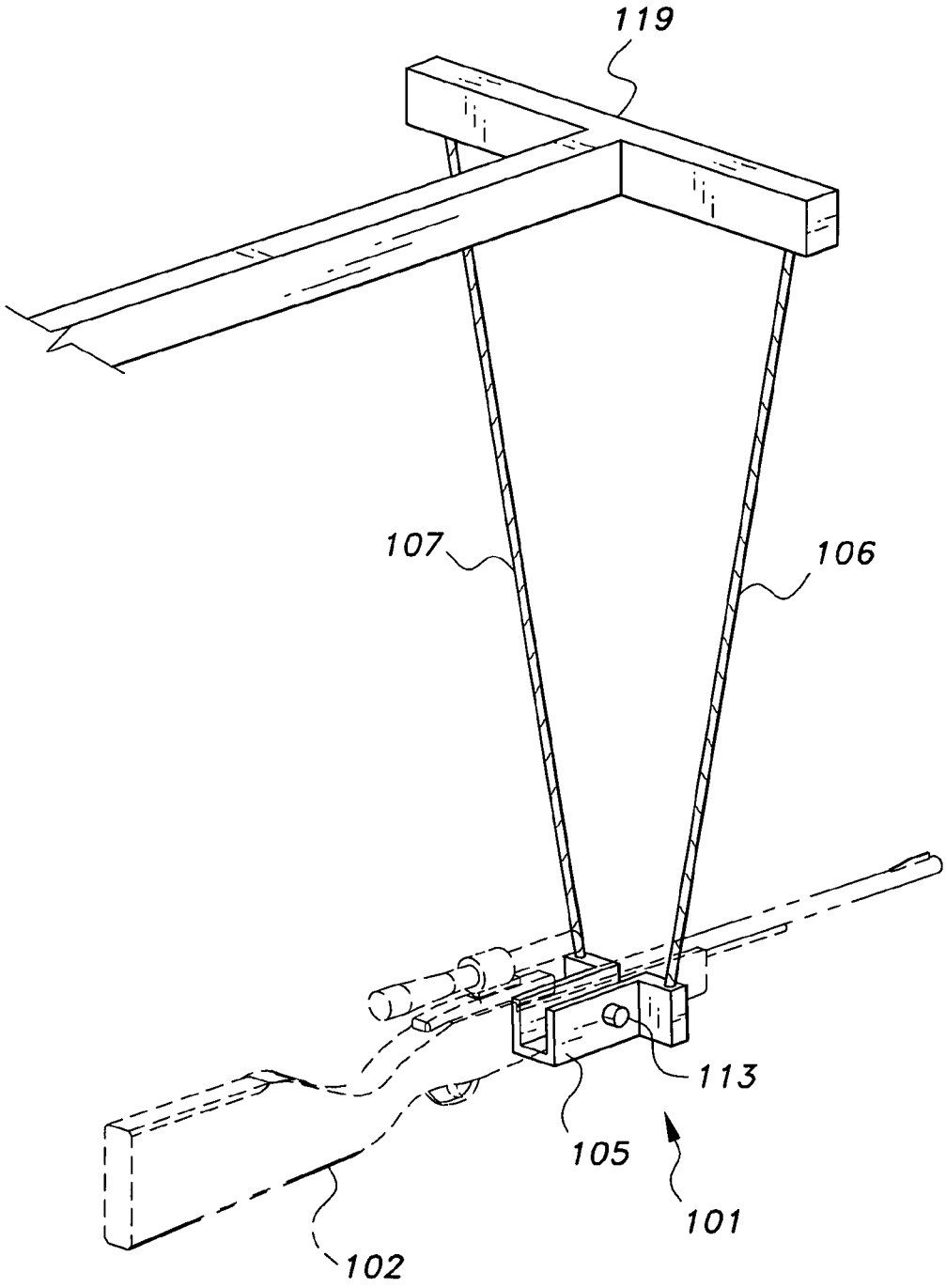
FIG. 16 is a perspective view of the rest configured for more stability in the horizontal direction.
Figure 23:
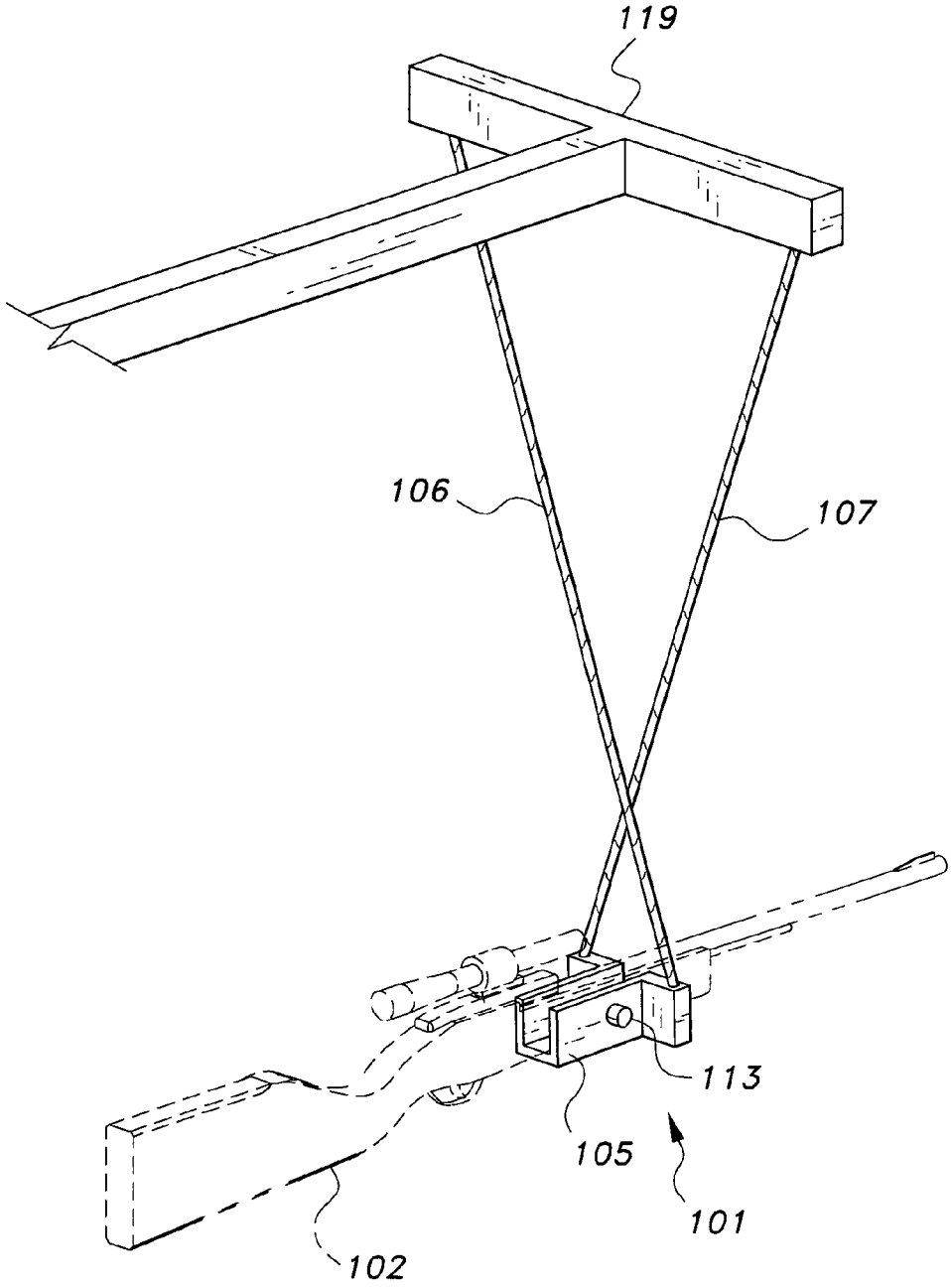
FIG. 23 is a perspective view of an alternative embodiment of the rest configured for more stability in the horizontal direction.

As seen in FIG. 15, the device also can be used for stabilizing a bow. Referring to FIG. 16, if two strings are used they can be separated to provide stability in the horizontal direction. The rifle 102 can be stabilized inside the cradle 105 by adding padding between the rifle 102 and the open slot 111 inside the cradle 105. As a further alternative, the cradle 105 can be strapped to the firearm 102 to prevent the rifle 102 from being removed from the cradle 105 during sudden movements and/or reloading of the rifle 102. It should be noted that the cradle 105 may be made of flexible and/or rigid material. FIG. 23 illustrates an alternative arrangement for strings 106, 107 in which the two strings are crossed, approximately at their centers, for added stability.

Further, the string may be wound and unwound with an electric motor (not shown). The suspended gun rest may be used with a variety of devices such as a camera, a spotting scope, video camera, etc. The string can be attached to any stable platform such as a tree branch, walking stick, bipod, tripod, etc.

It is to be understood that the present invention is not limited to the embodiments described above, but encompasses any and all embodiments within the scope of the following claims.

I claim:

1. A suspended gun rest, comprising:

a mount;

an arm pivotally attached to the mount;

a cradle having at least one string, the cradle having front and rear ends and having an open, substantially continuous slot formed therein and extending between the ends for receiving a firearm, the cradle further having a pair of laterally opposed wings extending outwardly from the slot and located adjacent the front end, each of the wings has at least one vertically oriented passage formed therethrough wherein the passages on the wings are horizontally aligned with each other, the at least one string passing through the passages;

a string routing system mounted within the cradle;

a spindle mounted for rotation in the cradle, the at least one string being partially wound about the spindle, the at least one string being connected to the spindle and routed through the cradle by the routing system;

means for selectively locking rotation of the spindle; and means for securing the at least one string, to the arm.

2. The suspended gun rest as recited in claim 1, wherein said mount comprises:

a bracket adapted for attachment to a rigid support; and means for releasably securing the bracket to the rigid support.

3. The suspended gun rest as recited in claim 2, wherein the bracket is substantially L-shaped, the bracket having first and second members orthogonally joined to one another, the first member having a mounting hole formed therethrough for receiving a bolt, the bolt pivotally joining said arm to the bracket.

4. The suspended gun rest as recited in claim 3, wherein said second member has a plurality of openings formed therethrough for receiving a plurality of fasteners for securing the bracket to the rigid support.

5. The suspended gun rest as recited in claim 1, wherein said string routing system comprises a pair of laterally opposed pins mounted within said cradle adjacent said pair of laterally opposed, vertically oriented passages, first and second portions of the at least one string partially wrapping around respective ones of said pair of laterally opposed pins to suspend said cradle.

6. The suspended gun rest as recited in claim 1, said string routing system further comprises a central pin mounted centrally between the pair of laterally opposed pins and adjacent said spindle, the first and second portions of the at least one string both being partially wound about the central pin.

7. The suspended gun rest as recited in claim 1, wherein said means for selectively locking rotation of said spindle comprises a lever pivotally mounted within said cradle, the lever having opposed first and second ends, the first end selectively engaging said spindle.

8. The suspended gun rest as recited in claim 7, wherein said spindle has a plurality of blocks circumferentially formed thereon, the first end of the lever being releasably received within spaces formed between adjacent ones of the plurality of blocks.

9. The suspended gun rest as recited in claim 7, wherein the first end of the lever frictionally engages a circumferential edge of said spindle.

10. The suspended gun rest as recited in claim 7, wherein the second end of the lever is spring-biased.

11. The suspended gun rest as recited in claim 10, further comprising a button mounted on the cradle, the button contacting the second end of the lever so that the user may selectively actuate the button to selectively pivot the lever with respect to said cradle.

12. The suspended gun rest as recited in claim 11, wherein a lateral passage is formed through said cradle for receiving a shaft of the button, the gun rest further comprising a helical spring disposed within the passage, the helical spring having an end contacting the second end of said lever.

13. The suspended gun rest as recited in claim 11, further comprising a torsion spring mounted in said cradle, one end of said torsion spring being attached to the second end of said lever.

14. The suspended gun rest as recited in claim 11, wherein the first end of said lever is at least partially formed from a material having a high coefficient of friction for frictionally engaging said spindle.

15. The suspended gun rest as recited in claim 14, wherein the first end of said lever comprises a frictionally engaging member, the frictionally engaging member being spring-biased against said spindle.

16. The suspended gun rest as recited in claim 11, wherein said spindle is spring-biased with respect to said cradle.

17. The suspended gun rest as recited in claim 1, wherein one end of the at least one string is fixed to said cradle.

18. The suspended gun rest as recited in claim 1, further comprising a pulley wheel mounted on said hook, the at least one string being partially wound about, and suspended from, the pulley wheel.

19. A gun rest adapted to be suspended from a suspension arm, comprising:

a cradle having at least one string, the cradle having front and rear ends and having an open, substantially continuous slot formed therein and extending between the ends for receiving a firearm, the cradle further having a pair of laterally opposed wings extending outwardly from the slot and located adjacent the front end, each of the wings has at least one vertically oriented passage formed therethrough wherein the passages on the wings are horizontally aligned with each other, the at least one string passing through the passages;

a string routing system mounted within the cradle;

a spindle mounted for rotation in the cradle, the at least one string being partially wound about the spindle, the at least one string being connected to the spindle and routed through the cradle by the routing system; and means for selectively locking rotation of the spindle.

20. The suspended gun rest as recited in claim 1, wherein the spindle comprises a spool-type shape with an opening formed in the central portion thereof, and a shaft located within the opening and connected to the cradle.

* * * * *